United States Patent [19]

Mele et al.

[11] 4,109,918

[45] Aug. 29, 1978

[54] LEARNING AND EARNING EDUCATIONAL GAME

[76] Inventors: Frank Mele; Margaret Mele, both of 607-90th St., North Bergen, N.J. 07047

[21] Appl. No.: 751,102

[22] Filed: Dec. 16, 1976

[51] Int. Cl.[2] ..... A63F 3/00

[52] U.S. Cl. ..... 273/256; 273/240; 273/243; 273/282

[58] Field of Search ..... 273/134 B, 134 E, 134 C, 273/134 G, 134 AB, 134 AF, 134 AD, 136 E, 136 K, 142 C, 142 D, 142 E, 142 F, 256, 243, 282; 35/9 R, 31 G, 35 J

[56] References Cited

U.S. PATENT DOCUMENTS

| | | | |
|---|---|---|---|
| 1,532,160 | 4/1925 | Seymour | 273/142 F |
| 2,717,156 | 9/1955 | Nelson | 273/134 C |
| 3,253,828 | 5/1966 | Joslyn | 273/136 E |
| 3,539,189 | 11/1970 | Shelton | 273/134 AF |
| 3,765,682 | 10/1973 | Braude | 273/134 AF |
| 3,850,433 | 11/1974 | Purlia | 273/134 E |
| 3,865,379 | 2/1975 | Breslow | 273/134 E |
| 4,029,320 | 6/1977 | Hausman | 273/134 C |

FOREIGN PATENT DOCUMENTS

| | | | |
|---|---|---|---|
| 5,114 | 10/1905 | France | 273/134 E |
| 16,813 | 8/1912 | France | 273/142 E |
| 115,087 | 10/1899 | Fed. Rep. of Germany | 35/9 R |
| 676,879 | 8/1952 | United Kingdom | 273/136 K |
| 1,266,949 | 3/1972 | United Kingdom | 273/134 B |

*Primary Examiner*—Richard C. Pinkham
*Assistant Examiner*—Harry G. Strappello
*Attorney, Agent, or Firm*—Richard L. Miller

[57] ABSTRACT

A game apparatus including a game board having a plurality of playing zones defining a circumferential path of travel around the board, each zone containing a respective designation of a discipline of learning. A roulette-type spinning wheel is positioned in the center of the gameboard and includes individual sections containing both numeric designations for providing the direction and magnitude of movement along the playing zones, as well as providing game instructions including references to various income opportunities. A plurality of playing pieces are included for use by the participants in moving around the path of travel. Groups of cards are included, wherein each group is associated with either a respective one of the disciplines of learning or a respective one of the income opportunities. Each card includes a statement or a question and answer with a corresponding dollar amount of income or expense. Financial instruments are also included such as play money, bonds and checks. Recesses on the game board provide storage room for the card after being used.

10 Claims, 9 Drawing Figures

CONST CASE
TAX SEAT SEAT LOSE CASH ON HAND
OUT-SICK COLLECT 5 TIMES INNER CIRCLE COMPENSATION INSURANCE
BOND #100
BOND #50
BOND #25
POLLAR
SCIENCE
MATH
STUDIES
CHECK
PAY TO ORDER OF
10
12
14
16
18
20
22
26
28
32
42
48
50
52
56
58
60
62
64
66
68
70
74
76
78
80
82
106

LEARNING AND EARNING EDUCATIONAL GAME

BACKGROUND OF THE INVENTION

This invention relates to game apparatus, and more particularly to a game providing learning instruction in various disciplines of learning as well as instruction in financial management of funds.

There are presently known numerous types of games providing instruction, skill, chance, or intrigue. However, most of these games are limited to providing only one of these types of benefits. For example, a game which includes learning instruction, such as questions and answers on various subject matters, has very little opportunity for chance, skill, or other enjoyment of the game. On the other hand, games which provide skill and/or chance provide little direct learning capabilities in any specific learning discipline. As a result, games which are purchased because of their teaching ability in a discipline of learning, are not enjoyed by the participants and are therefore not widely played. On the other hand, games which are purchased because of their chance, skill, or intrigue are widely played and are popular. However, there is little direct learning from such games.

It is therefore an object of the present invention to provide a game apparaus which avoids the aforementioned problems of prior art games.

A further object of the present invention is to provide a game which provides educational benefits as well as chance and skill.

Still another object of the present invention is to provide a game apparatus which provides direct instruction by means of questions and answers concerning various disciplies of learning.

Yet a further object of the present invention is to provide a game apparatus providing instruction both in financial administration as well as specifically designated disciples of learning.

A further object of the present invention is to provide a game apparatus which provides education in areas of learning and earning.

Yet another object of the present invention is to provide a game apparatus providing experience in using financial instruments, including paper money, bonds, and checks.

Still another object of the present invention is to provide a game apparatus using direct questions and answers as a method of learning various disciples of study.

These and other objects, features and advantages of the invention will, in part, be pointed out with particularity, and will, in part, become obvious from the following more detailed description of the invention taken in conjunction with the accompanying drawings, which form an integral part thereof.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

SUMMARY OF THE INVENTION

Briefly, the invention includes a game apparatus having a game board with a sequence of playing zones provided thereon and defining a path of travel on the gameboard. Designations of disciplines of learning are provided on the board in random association with respectives ones of the playing zones. A plurality of playing pieces are provided for use by the participants in the game. A roulette-type spinning wheel is supported on the game board and includes a dial face, ribs dividing the dial face into a plurality of sections, a spinner for rotating the dial face relative to the game board, and a ball which can bounce between the various sections during its rotation and ultimately reaches a rest position in one of the sections. Numeric designation are provided on the dial face in association with each section indicating a direction and magnitude of movement of the playing pieces along the path of travel. Game instructions are also designated on the dial face in association with each of the sections. Groups of cards are provided, wherein each group is associated with a respective one of the disciplines of learning. Each card has a question and answer associated with its respective disciples. Play money is also included for distribution among the game participants.

In an embodiment of the invention, the game board is of circular shape and forms the top surface of a cylindrical member. The dial face of the spinning wheel is also circular in shape and positioned centrally on the circular game board. The playing zones are also circular in shape and positioned as satellites to the spinning wheel and define a circumferential path of travel adjacent the perimeter of the game board.

In an embodiment of the invention the game instructions includes references to income opportunities. There are also included additional groups of cards; each of the additional groups being associated with a respective one of the income opportunities and each of the cards of these groups containing financial instructions.

BRIEF DESCRIPTION OF THE DRAWINGS

In the drawings.

In the various figures of the drawing, like reference characters designate like parts.

DESCRIPTION OF THE PREFERRED EMBODIMENT

Figures 1, 2:
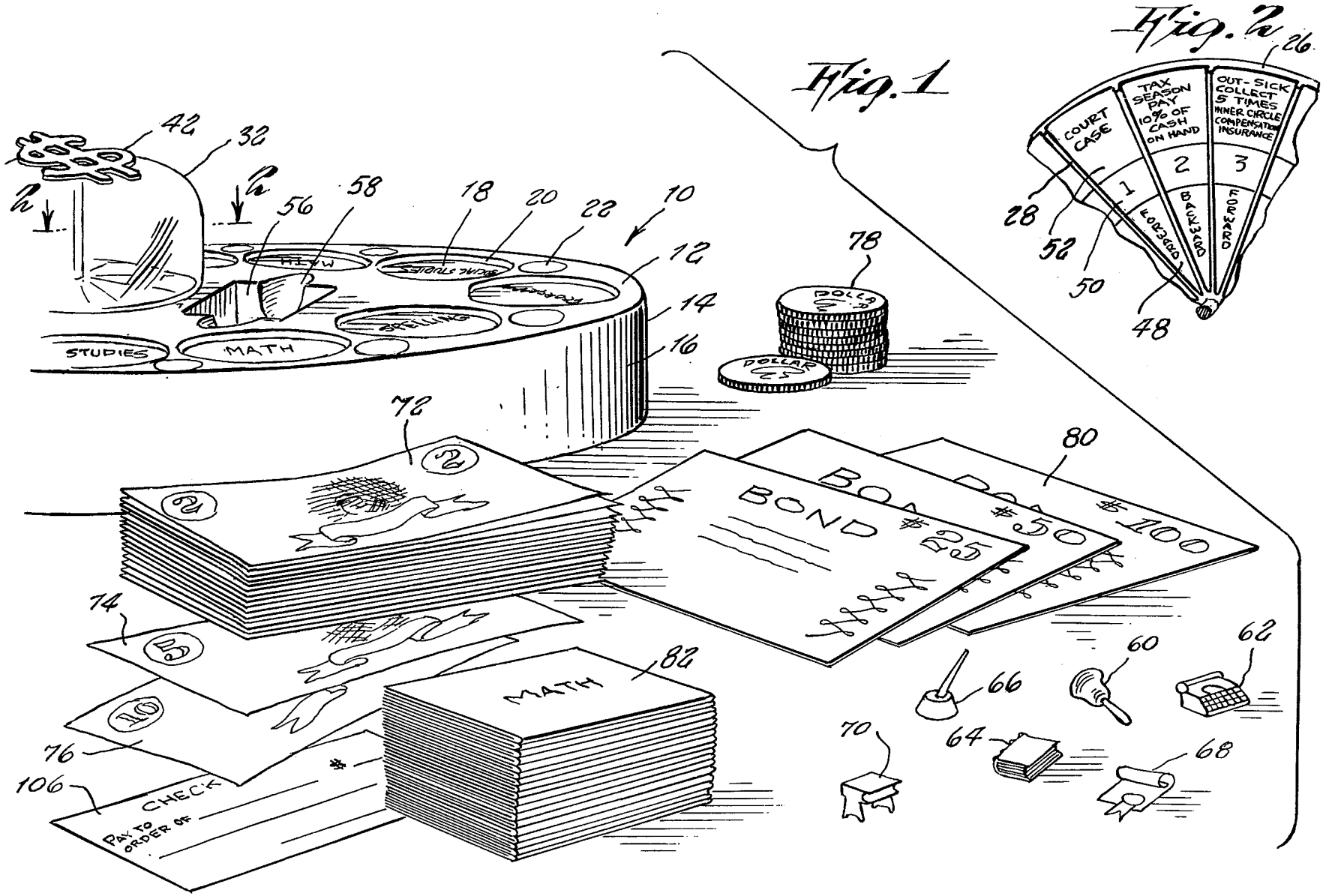
FIG. 1 is a perspective view showing the various components of the invention, including the game board with spinner, play money, deck of cards, set of bonds, and playing pieces.
FIG. 2 is a fragmentary elevational view of the spinner dial face as used on line 2—2 of FIG. 1.
Figure 3:
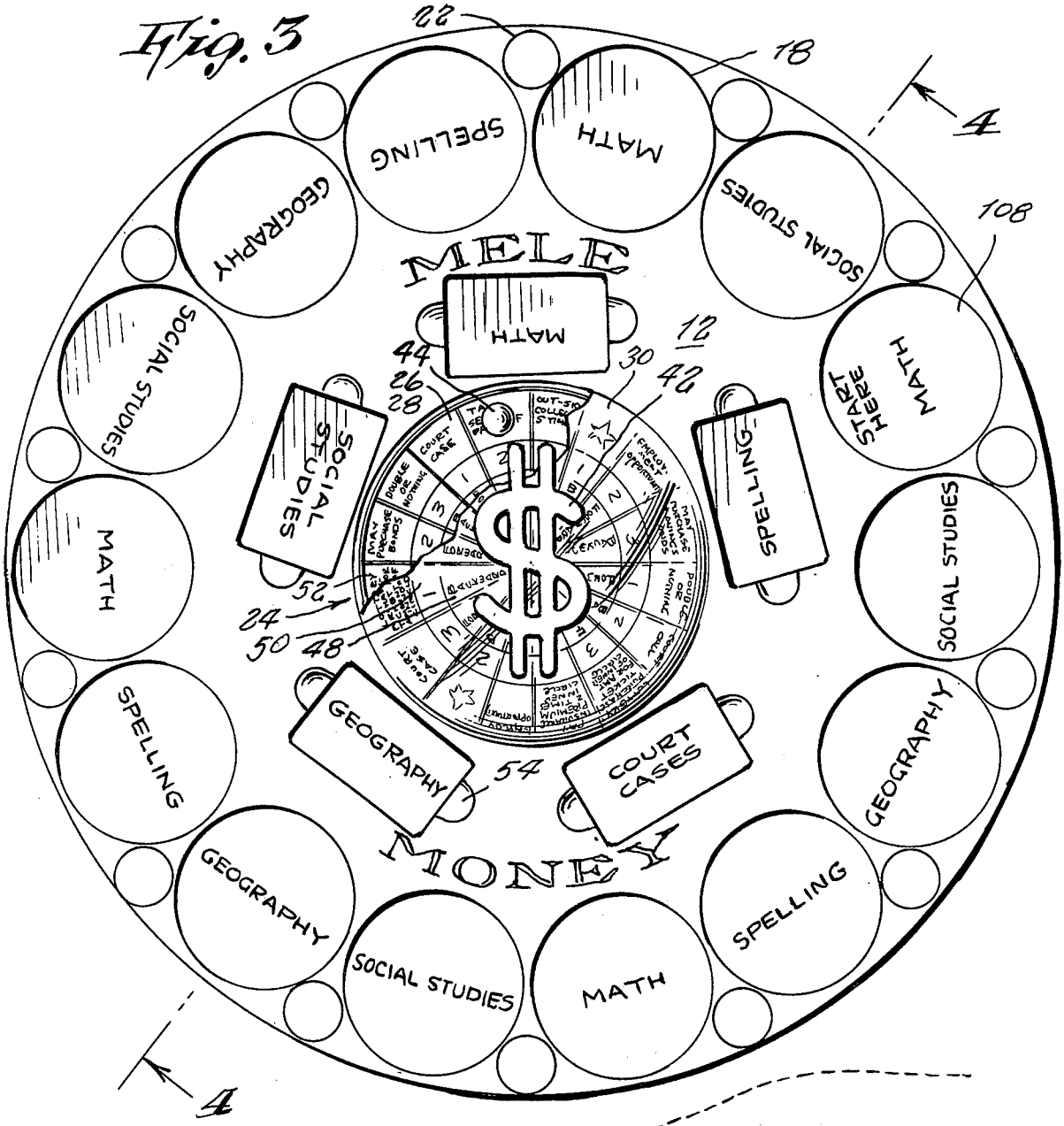
FIG. 3 is a top view of the game board and showing the spinner dome partly broken away so as to more clearly illustrate the dial face therebeneath.

Referring now to the drawings, and particularly FIGS. 1 through 4, the present game apparatus includes a game board, shown generally at 10, having an upper face 12 of substantially circular shape which forms the top of a cylinder having an upright sidewall 14. The game board is typically about 1½ inches high and represents a large silver dollar by including ribbed indentations on the wall.

Adjacent the outer periphery of the game board are a plurality of smaller satelite circles 18 forming playing zones. These are also found to represent smaller silver dollars and are slightly recessed beneath the upper face 12 of the game board and include side walls 20 forming the recessed portions. The recess is typically about ⅛ inch below the game board surface. Each of the playing zones 18 include a designation of a discipline of learning. In the embodiment shown, 14 individual playing zones 18 are shown, including designations of the disciplines of learning: "social studies," "spelling," "math," and "geography." It is understood that additional playing zones could be utilized and other learning disciplines could be substituted. Interspaced between each two playing zones is a smaller circle 22, representing a smaller coin.

Figure 4:
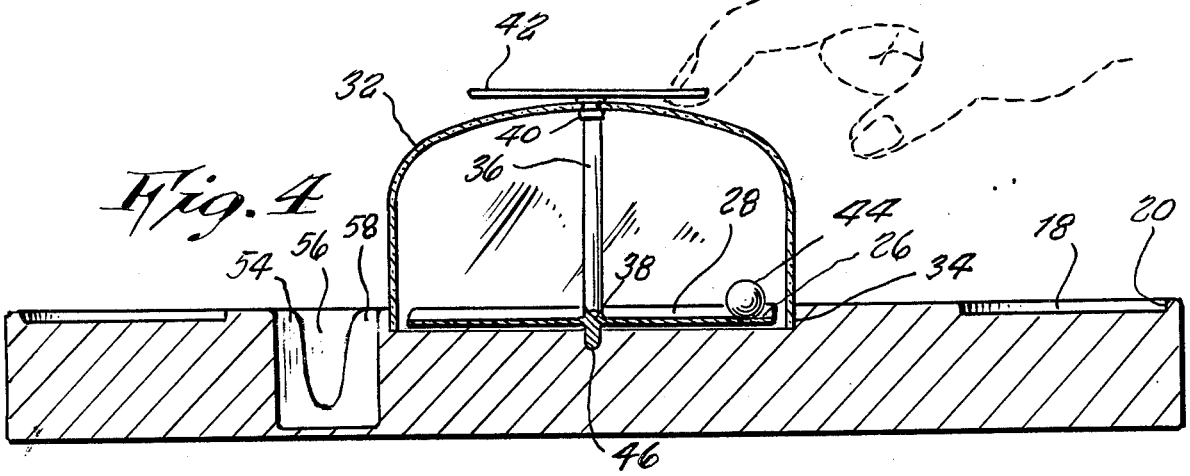
FIG. 4 is a cross sectional view of a game board taken along line 4—4 of FIG. 3.

Positioned at the center of the game board is a roulette-type spinning wheel, shown generally at 24, and including a dial face 26 separated into a plurality of sections 30 by radially positioned ribs 28. A transparent dome shaped cover 32 covers the dial face. The dial face is positioned within a recess 34 formed into the game board. The dome shaped transparent cover 32 fits within this recess to tightly maintain the spinning wheel in place. A spinner includes a rod 36 which is connected to the dial face at 38 and extends upwardly through the transparent dome 32. Washers 40 can be positioned on either side of the junction of the rod 36 with the dome 32 to facilitate rotation of the rod through the dome. A dollar sign handle 42 is connected to the top of the rod 36 and permits rotation thereof. A round shaped object 44, such as a ball or marble is placed within the dome on top of the dial face. As the dollar sign handle 42 is turned (as shown in FIG. 4) it causes the dial face to rotate relative to the game board. Forming the end 38 of the rod 36 in to recess 46 in the game board, facilitates the pivotal rotation with the board. As the dial face rotates, it causes the ball 44 to bounce around within the dome, from section to section over the various ribs. As the spinner comes to a halt, the ball will find a resting position in one of the sections, designating that section as the one selected.

Each section is divided into three portions by circumferential lines. The inner most portion 48 of the sections contain designations of forward or backward movement. The middle sections 50, contain numeric designations, shown as being any of the numbers 1, 2, or 3. The outermost portion 52 contains designation of game instructions. These game instructions include references to a various income opportunities. For example, some designations indicate reference to the purchase or redemption of bonds, others indicate an employment opportunity, yet others refer to court cases, some mention the purchase of a lottery ticket and others, the payment of an insurance premium. In addition, some sections contain general game instructions concerning payment or receipt of money and include a statement of double or nothing, and the designation of a star.

Recessed compartments 54 are positioned in circumferentially spaced relationship on the game board. The recesses 54 are positioned between the inner roulete-type spinning wheel and the outer playing zones. These compartments include an inner rectangular opening 56 and tapered side grooves 58 permitting the insertion of a participants finger into the recess. The recesses can be used for storing various of the cards, to be hereinafter described.

As shown in FIG. 1 a plurality of playing pieces are included for use by the participants in moving from playing zone to playing zone along the path of travel. The playing pieces include replicas of educational objects such as a school bell 60, a typewriter 62, a book 64, a pen and inkwell 66, a diploma 68, and a desk 70.

Also included in the game apparatus are financial instruments such as currency, lottery tickets, bonds, and checks. The currency shown include a $2.00 bill 72, a $5.00 bill 74, and a $10.00 bill 76. Aso shown are the silver dollar coin currency 78. The bonds 80 are shown to include $25.00 denominations, $50,00 denominations, and $100.00 denominations. Also shown are checks 106.

Additionally included in the game apparatus are groups of cards, each group associated with one of the disciplines of learning or with one of the income opportunities. For example, in FIG. 1 there is shown a group of math cards 82. There would similarly be a group of social study cards, a group of geography cards, and a group of spelling cards. There would also be provided a group of cards associated with employment opportunities and a group of cards associated with court cases.

Each of the cards associated with the disciplines of learning would contain questions and answers. The questions would be placed on one portion of the card and the answers at a hidden, second portion. The cards relating to the dsciplines of learning could further be arranged in subgroups with each subgroup associated with a particular financial reward. The card associated with the income opportunities would contain a specific statement of opportunity with a particular financial reward or punishment.

Figure 5:
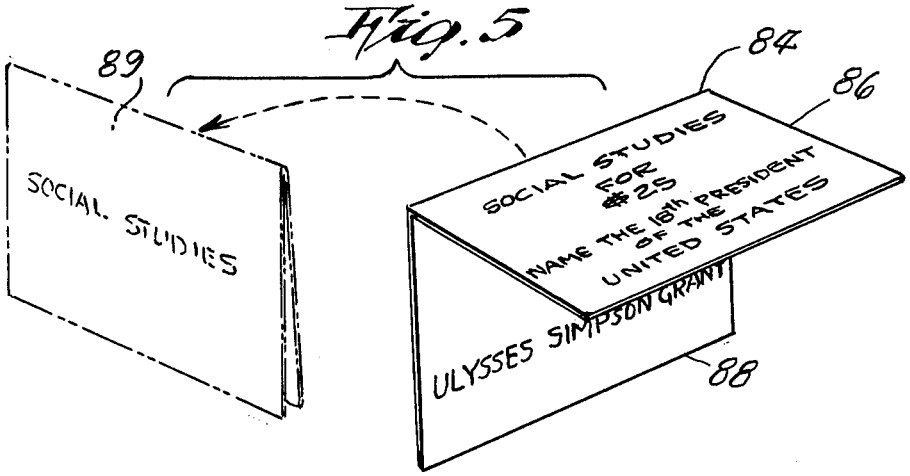
FIG. 5 shows a typical social studies card.

More specifically, there is shown in FIG. 5, a social studies card 84 folded over to include a front panel 86 and a rear panel 88. The particular social studies card shown indicates a reward of $25.00. The question is contained on the top face of the front panel 86 and the answer is contained on the top face of the rear panel 88. When in its folded form, shown in phantom, the front and back panels will lie flat. The particular name of the card, specifically the designation as a social studies card, is shown on the back face 89 of the rear panel 88.

Figure 6:
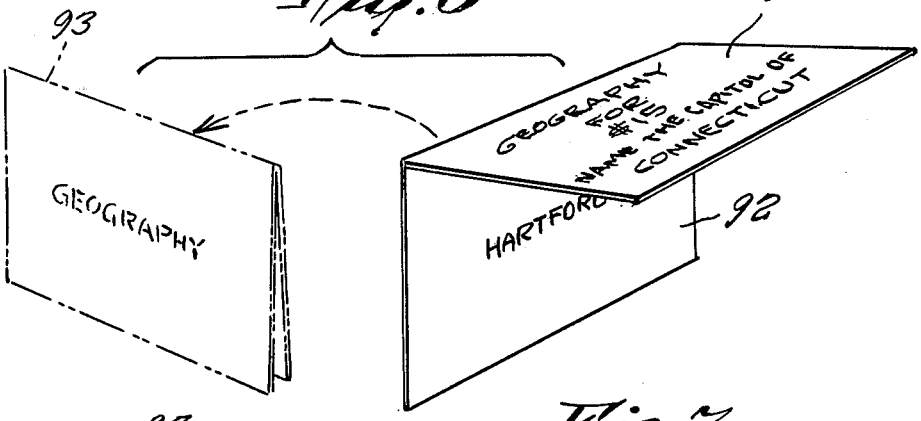
FIG. 6 shows a typical geography card.

Referring now to FIG. 6 there is shown a geography card having the designated title on the back face 93 of the rear panel 92. The top face of the front panel 90 contains the question and the top face of the rear panel 92 contains the answer. In this case, the proper response provides a financial reward of $15.00

Figure 7:
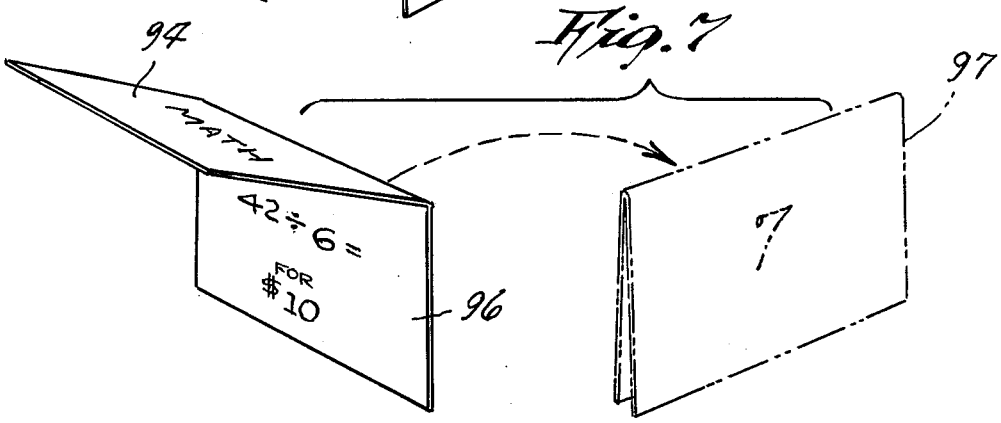
FIG. 7 shows a typical math card.

Referring now to FIG. 7 there is shown a math card. In this case the designated title of the card is written on the top of the front panel 94 and both the question and the financial reward are written on the top side of the rear panel 96. The answer is written on the back side 97 of the rear panel 96.

It will therefore be seen that in each of these three examples a sheet had been folded over to form a front and rear panel, and the various topside and backside portions of these panels are utilized for the title, question, answer, and financial reward. It will be understood, that a single card could be utilized without any folding over and its front and rear sides could provide all the information needed.

Figure 8:
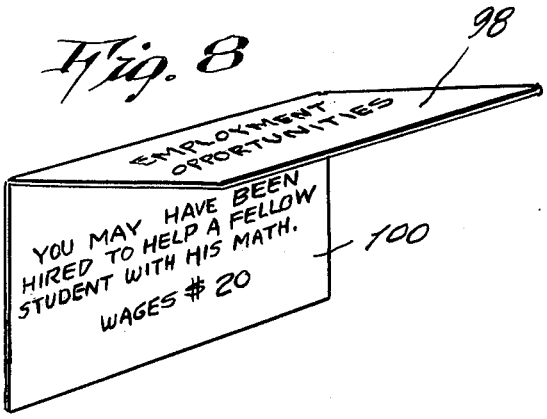
FIG. 8 shows a typical employment opportunity card.

Referring now to FIG. 8 there is shown a typical card of the employment opportunity group. In this specific case, there is again shown a front 98 and rear panel 100 with the top face of the front panel 98 bearing the title of the card, and the top face of the rear panel 100 bearing the particular financial instruction, as well as the financial reward. A financial punishment could similarly be indicated.

Figure 9:
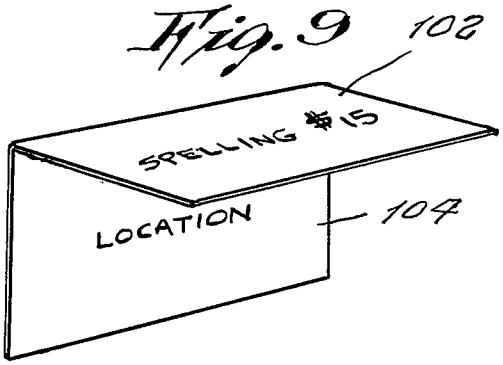
FIG. 9 shows a typical spelling card.

FIG. 9 shows a typical spelling card containing a front panel 102 and a rear panel 104. On the top face of the front panel 102 is written the designated title of the card as well as the financial remuneration. The particular word to be spelled is contained on the top face of the rear panel 104. In each of these cases a single card could be utilized with the front and rear of the card containing all of the information thereby avoiding the necessity of folding over the cards.

In addition to the cards shown, there would also be cards indicating court cases. There would also be the checks shown in FIG. 1 and lottery tickets.

The game is played in the following manner. To start, each player chooses one of the playing pieces for movement around the path of travel formed by the individual playing zones 18 around the outer periphery of the game board. The playing pieces are initially placed on one of the playing zones identified as the starting zone, shown in FIG. 1 as the zone 108. Each player then spins the roulette-type wheel by turning the dollar sign 42 on top of the dome 32. During the spin, the ball 44 will bounce from section to section but will be prevented from bouncing out of the spinner by means of the dome 32. The ball will finally come to rest in one section defined between two adjacent ribs. The section on which it rests will include a number indicating the number of playing zones along the playing path to be moved. Also, the direction of forward or backward movement will be given in each section. Additionally, the sections will contain specific game instructions relating to various financial opportunities.

The various instructions included on the section of the spinning wheel include the following: an employment opportunity; the permission to purchase bonds; a court case; instruction to pay taxes of a certain amount; and instruction to collect insurance; instructions concerning the purchase of a lottery ticket, and an indication of paying double or nothing. Furthermore, some sections contain the mark of a star.

In order to move the playing piece from the initial start playing zone 108, the player must have the ball 44 land on a section containing a star. After the initial move, each time the player lands on a section with a star, he may collect wages, as determined by the employment opportunities, or may collect dividends on his savings bonds. There are shown two sections having stars for these two respective purposes.

Wherever the ball lands, the player must move accordingly forward or backward the spaces indicated. Upon landing on a particular playing zone, he must then answer a question relating to the specific discipline of learning designated by the playing zone on which he lands. The questions are contained on the cards from the group associated with the particular discipline of learning. Within each group there are subgroups for particular financial amounts. For example, within the spelling group there are spelling questions worth $10.00, $15.00, and $25.00. The higher the monetary value of rewards, the harder the question. Similarly, for each of the other disciplines, social studies, geography and math, there are groups of cards and within each group there are subgroups for different financial remunerations.

If the player lands on the spelling card, he may choose whichever dollar value question he believes he is able to answer. He must then put up that amount of money. For example, if the player should choose a $25.00 spelling question, he must put up $25.00 of his own play money. If he answers the question incorrectly, he loses his $25.00 and must remain on that designated playing zone until he finally answers a question correctly. In other words he does not get a turn at the spinning wheel but each time his turn comes around he continues to select a dollar value question from the cards and continues to put up his own money until he is finally able to answer a question. When he answers a question correctly, he wins back his own money which he put up for that question, plus the additional amount indicated on the card. For example, if he were to answer the $25.00 spelling question correctly, he receives his own $25.00 plus an additional $25.00.

If the player chooses a particular dollar question and the ball of the spinning wheel has landed on a section indicating "double or nothing," the player must put up his dollar amount in accordance with the question. If he is incorrect he loses his money. If he is correct, he wins back twice the money, in addition to his own. For example, if he selects a $25.00 question, he must put up his own $25.00. If he is correct in answering the question, he wins back $50.00 plus his own original $25.00. If he is incorrect, he loses his $25.00.

If a player lands on an occupied space, he must pay the first occupant $10.00. The first occupant, however, must ask for the payment. As a result, the players must be alert at all times. Should the original player fail to request the $10.000 the second player does not pay it.

When the ball of the spinning wheel lands on a section marked by the designation "court cases," the player selects a particular card from the group of cards associated with court cases and must follow the instructions thereon. On these court case cards there will be included typical grievances relating to a class room situation and also providing a financial fine or reward. For example, the card may contain the statement "you have been found guilty of disobeying the classroom monitor, pay $15.00 fine." Or it may have the statement "you have been awarded $25.00 in damages for a personal injury suit against a fellow student."

When the ball of the spinning wheel lands on a section associated with savings bonds, the player can then purchase such bonds. The $25.00 bond can be purchased for $20.00 and will mature at the $25.00 value. Similarly, the $50.00 maturity bond can be purchased for $40.00, and the $100.00 maturity bond will be purchased for $80.00. The bond is purchased when the ball lands on the section marked "may purchase savings bonds." The bonds mature when the ball lands on a section marked with a star.

The lottery tickets may be purchased when the ball of the spinning wheel lands on a section indicating permissability to purchase them. Each lottery ticket contains an instruction concerning the winning or losing of a dollar amount. For example, the lottery ticket can contain the statment "you are a winner — collect ten times the number of the inner circle." Additionally, the lottery ticket contains statements on losing, or simply the statement "our lose."

A checking account may be opened when it is the player's turn and before the next player begins his turn.

The advantage of a checking account is that cancelled checks may be used as tax deductions. Taxes are paid when the ball of the spinning wheel lands on the section indicating the payment of taxes. The check may be used to pay a fine or may be used to put up the money against answering the questions on the particular disciplines of learning. The checks are of a type which can be reused. Each time the check is used, the amount as well as other financial information, such as the payee and the payor, is written on the check. However, the check is made of a material which can permit its reuse. For example, it can be made of a slick surface permitting the use of crayons which will wipe off the slick surface for reuse. Additionally, a slate with a cellophane type cover can be utilized so that it can be reused.

Banking may be done only when it is the players turn and before the next player begins his turn. During banking, the player may want to deposit money in his checking account or cash in bonds. When a bond matures, the player is given a gold clip to attach to the bond showing that it has matured.

In order to play the game, there should be at least two players, plus an additional teacher-banker. The two players oppose each other and the third player serves to distribute money and control of cards. There can be as many as seven players, with six actually playing and one serving as the teacher-banker. The teacher-banker must initially give each player $100.00 in play money to start the game. He must ask all questions from the top card of the particular category the player requests. He then tells the players whether they are correct or incorrect. If the player is incorrect, the banker-teacher then collects the money and places it into the bank. If the player is correct, the banker-teacher pays the appropriate amount. He then places the question and answer card face up in one of the storage compartments provided on the game board so that all of the other players can verify the correct answer. A number of these compartments are sufficient to accommodate the various cards associated with the disciplines of learning, as well as the cards associated with the economic opportunity such as the court cases, lottery tickets and employment opportunities. The banker-teacher also pays dividends for bonds, reads the court cases, and pays and receives all appropriate money. He also reads the job opportunities and pays the wages.

The ball landing on the section indicating "employment opportunities" causes the selection of a particular card from the group associated with the employment opportunities. These cards contain financial reward or financial payments associated with class room employment opportunities. For example, as shown in FIG. 8, the card contains the statement "you may have been hired to help a fellow student with his math-wages $20.00."

In order to facilitate the banker-teacher holding the various funds, a bank can be provided which consists of a row of plastic compartments for each subject according to the dollar value of each question. Also, a row of compartments with different sections can be provided in accordance with the different denominations of the play money. The bank can also have special compartments for the lottery tickets, employment opportunities, savings bonds and court cases.

The game design is such that supplements may be available to modify the questions. For example, different sets of questions can be provided so that after a player learns the subject matter presented in the original game, he can purchase additional sets to continue learning. Furthermore, the questions and answers can be made for different grade levels so that children and adults of all ages can find the game attractive and educational.

Since the game is both an educational and financial game, the game design can be in accordance with monetary colors and designations. For example, the game box can be shaped like a dollar bill and be made out of the colors green and white to resemble paper currency. Additionally, the various shapes are that of coins and silver dollars.

It will therefore be appreciated, that the present game is both educational as well as challenging. It provides an opportunity for learning questions associated with various disciplines of learning. At the same time, it contains enjoyment because of the chance provided by the spinning wheel and the various cards. Also, it provides educational instruction concerning financial matters since it includes various financial instruments such as bonds, lottery tickets, checks, and currency.

There has been disclosed heretofore the best embodiment of the invention presently contemplated. However, it is to be understood that various changes and modifications may be made thereto without departing from the spirit of the invention.

What is claimed is:

1. A game apparatus comprising, in combination:

(a) a game board having provided thereon a sequence of playing zones defining a path of travel on the game board, first identification means for designating disciplines of learning being provided in random association with respect to each of said playing zones;

(b) a plurality of playing pieces for use by the participants, said playing pieces being positionable on said playing zones;

(c) a roulette-type spinning wheel supported on said game board and including a dial face, radial ribs dividing said dial face into a plurality of sectors, a spinner for rotating said dial face relative to said game board, a single ball for bounding between said sectors and reaching a rest position in one of said sectors, numeric designation means provided on said dial face in association with each sector representing a direction and magnitude of movement of said playing pieces along said path of travel, second identification means for designating game instructions provided on said dial face also in association with each of the same sectors;

(d) groups of cards, each group correspondingly identified with said first identification means, each card containing thereon a question and answer;

(e) additional groups of cards, each of said additional groups correspondingly identified with said second identification means, and (f) play money for distribution among the game participants.

2. A game apparatus as in claim 1 and wherein said first identification means designate disciplines of learning, each group of said groups of cards being associated with a respective one of said disciplines of learning, said questions and answers being associated with its respective field of study, said second identification means designate game instructions including reference to a plurality of income opportunities and wherein each of said additional groups of cards are respectively associated with one of said income opportunities, each card of said additional groups of cards containing financial instructions.

3. A game apparatus as in claim 2 and wherein said game board is of circular shape and forms the top surface of a cylindrical member, the dial face of said spinning wheel is of circular shape and is positioned centrally of said circular game board, and said playing zones are each circular in shape and positioned tangentially adjacent each other near the outer edge of said circular game boad defining a circular path of travel concentric with the circular game board and adjacent the outer perimeter thereof.

4. A game apparatus comprising, in combination:

a game board having provided thereon a sequence of playing zones defining a path of travel of the game board, designations of disciplines of learning being provided on said game board in random association with respect to each of said playing zones; a plurality of playing pieces for use by the participants, said playing pieces being positionable on said playing zones; a roulette type spinning wheel supported on said game board and including a dial face, ribs dividing said dial face into a plurality of sections, a spinner for rotating said dial face relative to said game board, a ball for bounding between said sections and reaching a rest position in one of said sections, numeric designations provided on said dial face in association with each section indicating a direction and magnitude of movement of said playing pieces along said path of travel, game instruction designations provided on said dial face also in association with each sections; groups of cards, each group associated with a respective one of said disciplines of learning, each card containing thereon a question and answer associated with its respective field of study; play money for distribution among the game participants; said game instructions including reference to a plurality of income opportunities and further comprising additional groups of cards each of said additional groups respectively associated with one of said income opportunities, and each card of said additional groups of cards containing financial instructions; said game board being of circular shape and forming the top surface of a cylindrical member, the dial face of said spinning wheel being of circular shape and positioned centrally of said circular game board, said playing zones being each circular in shape and positioned tangentially adjacent each other near the outer edge of said circular game board defining a circular path of travel concentric with the circular game board and adjacent the outer perimeter thereof, and further comprising a plurality of circumferentially spaced apart recessed compartments, each compartment being positioned between said spinning wheel and said playing zones, each compartment respectively storing cards from said groups and additional groups of cards.

5. A game apparatus as in claim 4 and wherein each of said circular playing zones are recessed below the surface of said game board.

6. A game apparatus as in claim 4 and further comprising a recessed portion in the center of said game board for accommodating said dial face, a dome shaped transparent cover means covering said dial face, and wherein said spinner includes a rod connected to said dial face and having one end thereof rotationally positioned in the center of the said game board and the other end thereof extending through said cover means to be manipulated externally therefrom.

7. A game apparatus as in claim 4 and wherein said income opportunities include the purchase of bonds, and further comprising play bonds for purchase and redemption by the participants.

8. A game apparatus as in claim 4 and further comprising play checks for use by the participants, capable of insertion thereon of financial indicia and capable of reuse by removal of said indicia.

9. A game apparatus as in claim 4 and wherein each card of said group and additional groups of cards comprise a sheet with a center fold therein forming front and rear panels, said panels being utilized for said questions, and answers, and financial instructions.

10. A game apparatus as in claim 4 and wherein each group of cards comprises a plurality of subgroups of cards, each subgroup associated with a different financial amount of remuneration and containing designations relating to said remunerations.

* * * * *